US009325119B2

(12) United States Patent
Wu et al.

(10) Patent No.: US 9,325,119 B2
(45) Date of Patent: Apr. 26, 2016

(54) CABLE CONNECTOR ASSEMBLY WITH AN IMPROVED GROUNDING CONTACT

(71) Applicant: HON HAI PRECISION INDUSTRY CO., LTD., New Taipei (TW)

(72) Inventors: Jerry Wu, Irvine, CA (US); Jun Chen, Kunshan (CN); Zhan-Feng Song, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/162,763

(22) Filed: Jan. 24, 2014

(65) Prior Publication Data

US 2014/0220821 A1 Aug. 7, 2014

(30) Foreign Application Priority Data

Feb. 4, 2013 (CN) ..... 2013 1 0042392

(51) Int. Cl.

| | |
|---|---|
| ***H01R 24/00*** | (2011.01) |
| ***H01R 13/6471*** | (2011.01) |
| ***H01R 13/6461*** | (2011.01) |
| *H01R 4/02* | (2006.01) |
| *H01R 13/6597* | (2011.01) |
| *H01R 24/30* | (2011.01) |

(52) U.S. Cl.

CPC ..... *H01R 13/6471* (2013.01); *H01R 13/6461* (2013.01); *H01R 4/023* (2013.01); *H01R 13/6597* (2013.01); *H01R 24/30* (2013.01)

(58) Field of Classification Search

CPC ..... H01R 2103/00; H01R 13/65802; H01R 13/658; H01R 23/7073

USPC ..... 439/188, 607.01, 607.25, 607.54, 439/607.55, 660

See application file for complete search history.

(56) References Cited

U.S. PATENT DOCUMENTS

| | | | | |
|---|---|---|---|---|
| 8,011,959 | B1 * | 9/2011 | Tsai et al. | 439/607.25 |
| 8,118,497 | B2 * | 2/2012 | Yi | 385/93 |
| 8,142,226 | B2 | 3/2012 | Xiao et al. | |
| 8,500,494 | B2 * | 8/2013 | Wu | 439/660 |
| 8,597,060 | B2 * | 12/2013 | Wu | 439/660 |
| 8,662,933 | B2 * | 3/2014 | Wu | 439/660 |
| 8,668,523 | B2 * | 3/2014 | Wu | 439/607.23 |
| 8,696,385 | B2 * | 4/2014 | Wu | 439/607.56 |
| 8,801,470 | B2 * | 8/2014 | Hsueh | 439/660 |
| 8,814,599 | B2 * | 8/2014 | Wu | 439/607.48 |

FOREIGN PATENT DOCUMENTS

| | | |
|---|---|---|
| CN | 202695862 | 1/2013 |

* cited by examiner

*Primary Examiner* — Thanh Tam Le

(74) *Attorney, Agent, or Firm* — Wei Te Chung; Ming Chieh Chang

(57) ABSTRACT

A cable connector assembly comprises an insulative housing, a plurality of first contacts and second contacts, a cable electrically connected with the contacts, a metallic shell enclosing the insulative housing. The first contacts are received in the first tongue, and the second contacts are held in the second tongue, the second contacts have a grounding contact in the middle thereof. The cable has an aluminum foil, and a front part of the aluminum foil is stripped away. The grounding contact has an extending configuration extending beyond back ends of other contacts along a front to back direction and a pair of soldering portions on both sides of the extending configuration, the extending configuration has a Z-shaped cross-section and extends rearwards to a front end of the aluminum foil.

16 Claims, 6 Drawing Sheets

CABLE CONNECTOR ASSEMBLY WITH AN IMPROVED GROUNDING CONTACT

BACKGROUND OF THE INVENTION

1. Field of the Invention

The present invention generally relates to a cable connector assembly, and more particularly to a cable connector assembly for high speed signal transmission.

2. Description of Related Art

U.S. Pat. No. 8,500,494 issued to Wu on Aug. 6, 2013 discloses a cable connector assembly in accordance with USB 3.0 standard, the cable connector assembly comprises an insulative housing, a plurality of contacts received in the insulative housing, a cable connected with the contacts, a metallic shell enclosing the insulative housing, and a pair of latches retained in the insulative housing and exposed out of the metallic shell. Tail portions of the contacts are extending beyond a rear end of the insulative housing and retained in grooves of a spacer, to be electrically connected with a cable, at least one of the contacts comprises a main body extending along a mating direction and a pair of horizontal soldering portions.

As the profile of the cable connector assembly becomes smaller, cross-talk may occur between the cable and the contacts. Particularly for a cable connector assembly used for transmitting high speed signal, cross-talk occurs around an area of an aluminum foil of a stripped cable.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved grounding contact for preventing cross-talk.

In order to achieve the above-mentioned object, a cable connector assembly in accordance with the present invention comprises an insulative housing including a first tongue and a second tongue, a plurality of first contacts received in the first tongue and a plurality of second contacts held in the second tongue, a cable electrically connected with the contacts, and a metallic shell enclosing the insulative housing. The second contacts are used for transmitting high speed signal and have a grounding contact in the middle thereof. The cable has an aluminum foil, and a front part of the aluminum foil is stripped away. The grounding contact has an extending configuration extending beyond back ends of other contacts along a front to back direction and a pair of soldering portions on both sides of the extending configuration, the extending configuration has a Z-shaped cross-section and extends rearwards to a front end of the aluminum foil.

Other objects, advantages and novel features of the invention will become more apparent from the following detailed description of the present embodiment when taken in conjunction with the accompanying drawings.

DETAILED DESCRIPTION OF THE INVENTION

Figure 1:
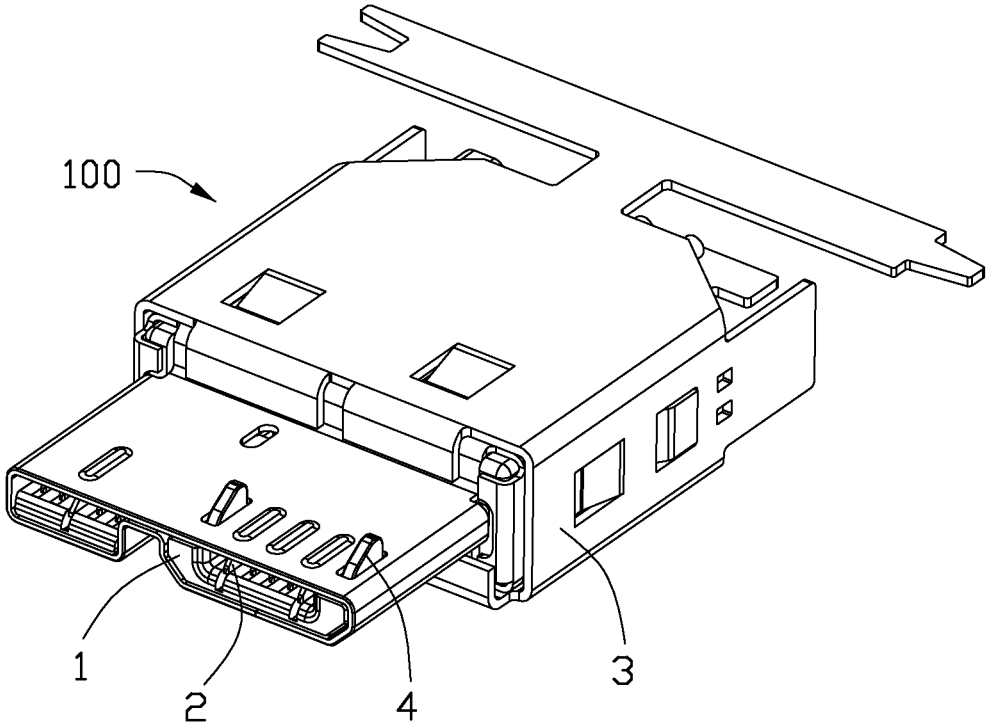
FIG. 1 is an assembled, perspective view of a cable connector assembly in accordance with the present invention.

Reference will now be made to the drawing figures to describe the present invention in detail.

Figure 2:
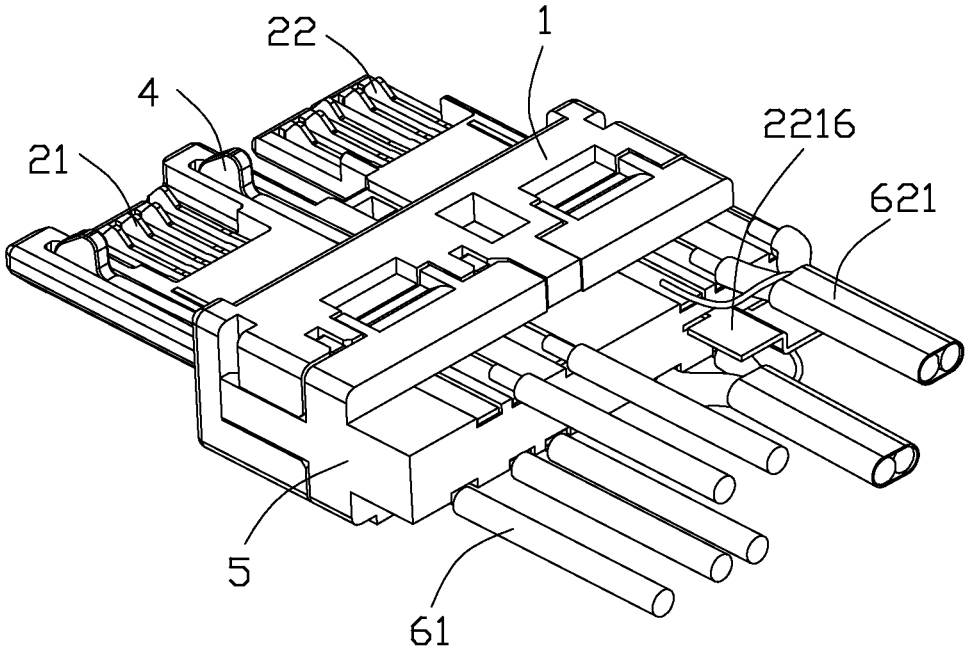
FIG. 2 is an assembled, perspective view of a cable connector assembly when a metallic shell removed shown in FIG. 1.
Figure 3:
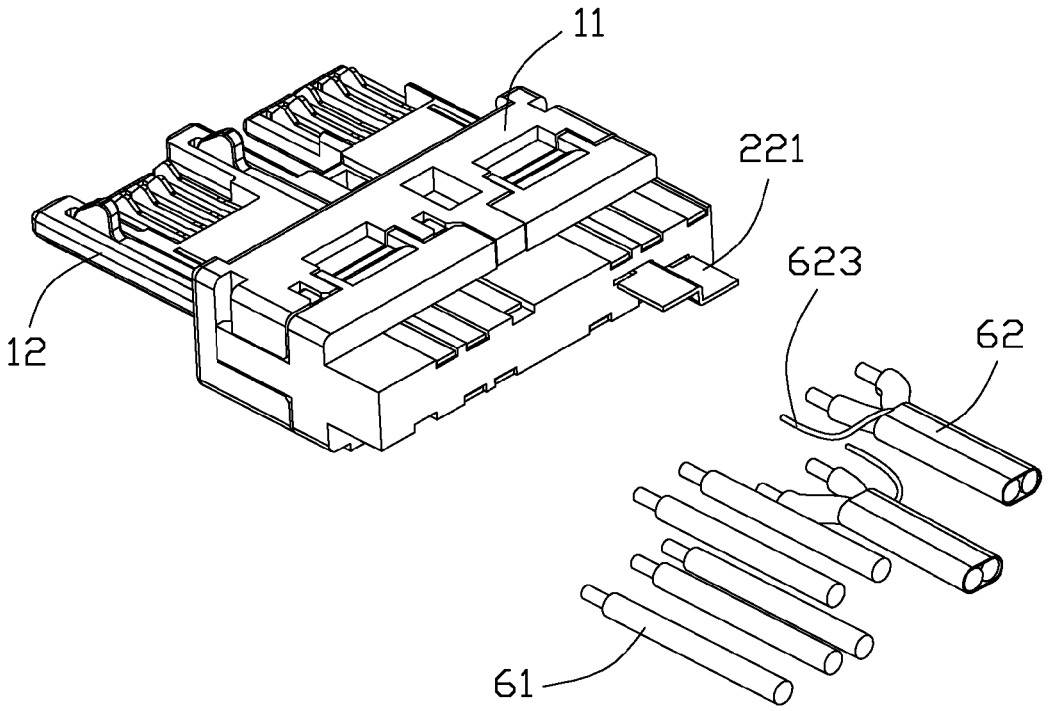
FIG. 3 is a partially exploded, perspective view of the cable connector assembly before contacts connected with a cable shown in FIG. 2.
Figure 4:
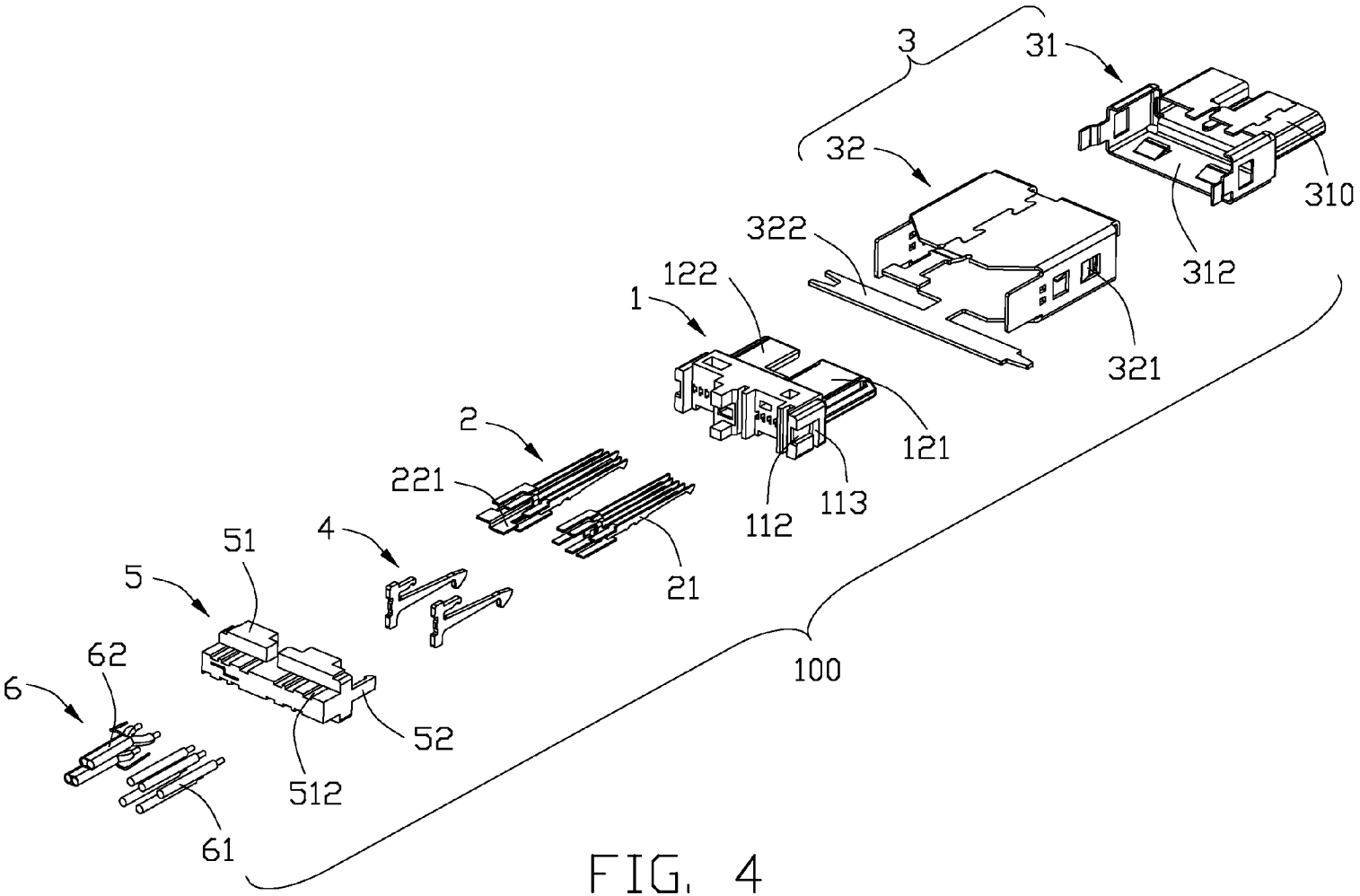
FIG. 4 is an exploded, perspective view of the cable connector assembly shown in FIG. 1.

Referring to FIGS. 1-4, a cable connector assembly 100 made in accordance with the present invention comprises an insulative housing 1, a plurality of contacts 2 held in the insulative housing 1, a metallic shell 3 enclosing the insulative housing 1, a pair of latches 4 retained in the insulative housing 1 and exposed out of the metallic shell 3, a spacer 5 fastened to the insulative housing 1 to support contacts 2, and a cable 6 electrically connected with the contacts 2.

Figure 5:
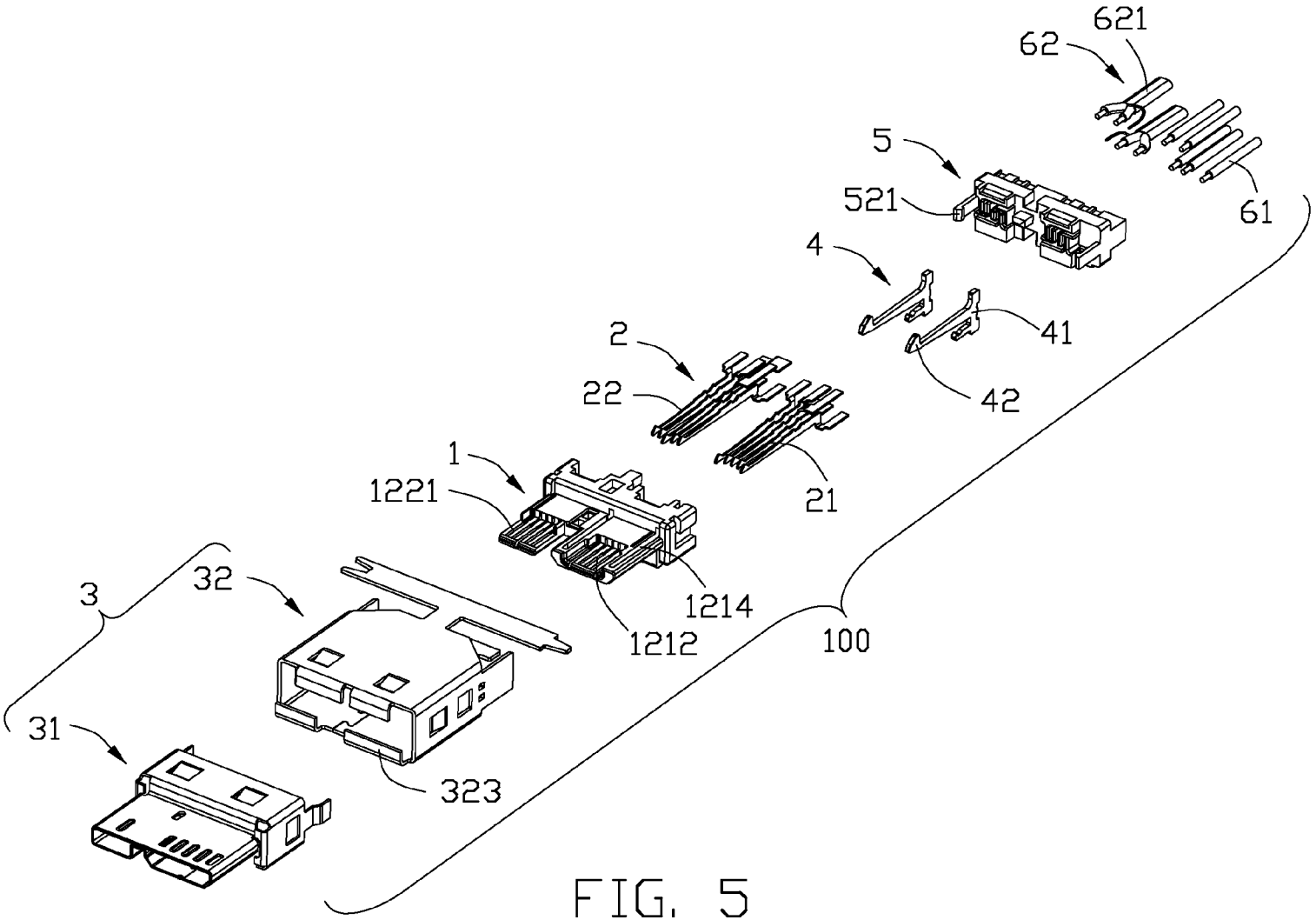
FIG. 5 is view similar to FIG. 4, but viewed from a different angle.
Figure 6:
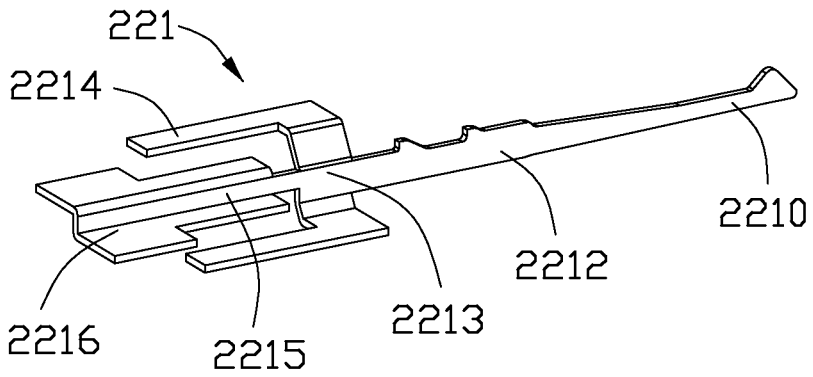
FIG. 6 is an enlarged perspective view of a grounding contact of the cable connector assembly shown in FIG. 4.

Referring to FIGS. 2-6, the insulative housing 1 includes a base portion 11 and a tongue portion 12 integrally extending forwardly beyond the base portion 11. The tongue portion 12 is split into a first tongue 121 and a second tongue 122 side by side arranged with each other and disposed in a common plane. The first tongue 121 is wider than the second tongue 122. The base portion 11 has a pair of lateral walls opposite to each other, and each lateral wall defines a first slot 112 along a mating direction and a second slot 113 perpendicular to the first slot 112. The second slot 113 is communicated with the first slot 112 and deeper than the first slot 112.

The first tongue 121 and the second tongue 122 are located on a same horizontal level, to make sure the cable connector assembly 100 with a low profile, and the size of the first tongue 121 is accordance with USB 2.0 standard. The first tongue 121 defines a plurality of first passages 1212 parallel to each other, the first passages 1212 are extending along the mating direction, and extending through the base portion 11. A pair of channels 1214 are defined on lateral sides of the first passages 1212 to receive the latches 4, and the channels 1214 are extending through the base portion 11.

Similar to the first tongue 121, the second tongue 122 defines a number of second passages 1221 parallel to the first passages 1212, and the second passages 1221 are extending through the base portion 11.

The contacts 2 include a plurality of first contacts 21 and a plurality of second contacts 22, and the first contacts 21 are received in the corresponding first passages 1212 with the second contacts 22 received in the corresponding second passages 1221. The first contacts 21 are compatible to version 2.0 Micro Universal Serial Bus.

The second contacts 22 include five conductive contacts, and the middle one of the second contacts 22 is a grounding contact 221 in middle, a pair of signal contact for transmitting high speed signal and a pair of signal contacts for receiving high speed signal are located on both sides of the grounding contact. The grounding contact 221 has a special configuration different from other second contacts.

The grounding contact 221 comprises a front contacting portion 2210, a retaining portion 2212 extending rearwards from the contacting portion 2210, a conjunction portion 2213 extending rearwards from the retaining portion 2212, a pair of soldering portions 2214 connected with opposite ends of the conjunction portion 2213, and an extending configuration located between the two soldering portion 2214 along a vertical direction. The extending configuration defines a first extending portion 2215 connected with the conjunction portion 2213 and a second enlarged portion 2216 on a free end thereof. The second enlarged portion 2216 is extending rearwards from the first extending portion 2215, and two opposite surfaces of the second enlarged portion 2216 on left and right sides are extending outwards relative to the first extending portion 2215. The soldering portions 2214 are located on left side and right side of the retaining portion 2212. Both the first extending portion 2215 and the second enlarged portion 2216 have a Z-shaped configuration in a cross-section view along the vertical direction, and the second enlarged portion 2216 has a large size than the first extending portion 2215. The second enlarged portion 2216 of the grounding contact 221 extends backwards beyond other contacts 2.

The metallic shell 3 includes a front shell 31 and a rear shell 32. The front shell 31 comprises a sleeve portion 310 in the front thereof and an engaging portion 312 extending rearwards from the sleeve portion 310. The sleeve portion 310 is divided into two juxtaposed mating cavities for receiving the first tongue 121 and the second tongue 122 by a depression (not labeled). The rear shell 32 defines a front main body 321 with a cross-section view of rectangular frame shape and a rear clipping portion 322, the main body 321 is assembled to the engaging portion 312.

Each latch 4 comprises a retaining standoff 41 held in the base portion 11 of the insulative housing 1 and an engaging arm 42 extending forwards from the retaining standoff 41, the engaging arm 42 is received in the relative channel 1214 of the insulative housing 1.

The spacer 5 is made of insulative material, and comprises a primary portion 51 and a pair of elongate arms 52 extending forwards from lateral sides of the primary portion 51. Each elongate arm 52 defines a tuber 521 on a front end thereof for assorting with the corresponding lateral wall of the insulative housing 1. A plurality of grooves 512 are defined on a top surface and a bottom surface of the extension portion 51, for receiving the tail portions of the contacts 2.

The cable 6 is divided into two groups, and the first group comprises five individual wires 61 connected with the first contacts 21, and the second group comprises a pair of high speed signal wires 62 for high speed signal transmission. Each high speed signal wire 62 comprises a plurality of inner wires (not labeled) and an aluminum foil 621 enwrapped on the inner wires, front part of the aluminum foil 621 is stripped away to make front part of inner wires exposed.

In assembly, the contacts 2 are inserted into the insulative housing 1 along a back-to-front direction, the first contacts 21 and the second contacts 22 are accommodated in the first passages 1212 of the first tongue 121 and the second passages 1221 of the second tongue 122 respectively, the latches 4 are inserted into the channels 1214 of the first tongue 121. Then the spacer 5 is assembled to a back end of the insulative housing 1 along the back-to-front direction, the elongate arms 52 on both sides of the spacer 5 are sliding in the first slots 112 of the insulative housing 1, until the tubers 521 of the elongate arms 52 locked in the second slots 113.

The tail portions of the contacts 2 are exposed in the corresponding grooves 512 of the spacer 5. The individual wires 61 of the cable 6 are soldered to corresponding tail portions of the first contacts 21, the high speed signal wires 62 are electrically connected with the second contacts 22. The soldering portions 2214 of the grounding contact 221 are received in the corresponding grooves 512 and soldered with corresponding grounding wires 623 of the high speed signal wires 62, and the first extending portion 2215 is isolated in the spacer 5, the second enlarged portion 2216 is extending beyond a back end of the spacer 5.

The soldering portion 2214 are aligned with the first extending portion 2215 along a transverse direction, for decreasing cross-talk in signal transmission. The second enlarged portion 2216 is extending rearwards to locate between the two aluminum foils 621 of the pair of high speed signal wires 62 along the vertical direction, in other words, the second enlarged portion 2216 extends beyond front ends of the aluminum foils 621 along a front to back direction. In other embodiment of the present invention, at least a rear end of the second enlarged portion 2216 is coplanar with the front ends of the aluminum foils 621, thus can depress cross-talk.

Then the insulative housing 1 is assembled into the front shell 31, the rear shell 32 is enclosing on a rear segment of the front shell 31, front edges 323 on a front end of the rear shell 32 are located in front of a front surface of the base portion 11, and the front edges 323 are adjacent to the front surface of the base portion 11. Side portions of the front shell 31 and the rear shell 32 are cooperated with each other to make the front shell 31 engage with the rear shell 32. Thus, the cable connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing including a base portion, a first tongue and a second tongue extending forwardly from the base portion;

a plurality of first contacts received in the first tongue and a plurality of second contacts held in the second tongue, the second contacts used for transmitting high speed signal and having a grounding contact in the middle thereof;

a cable electrically connected with the second contacts and having an aluminum foil, a front part of the aluminum foil being stripped away; and a metallic shell enclosing the insulative housing;

wherein the grounding contact has an extending configuration rearward extending far beyond back ends of all other second contacts along a front to back direction and a pair of soldering portions on both sides of the extending configuration, and the extending configuration has a Z-shaped cross-section and extends rearwards to a front end of the aluminum foil;

wherein the extending configuration defines a first extending portion and a second enlarged portion on a free end thereof, and the second enlarged portion extends beyond the front end of the aluminum foil along the front to back direction; and wherein each of the first extending portion and the second enlarged portion has a Z-shaped configuration viewed along the front to back direction.

2. The cable connector assembly as claimed in claim 1, wherein a soldering area between the second contacts and the cable is aligned with the first extending portion along a transverse direction.

3. The cable connector assembly as claimed in claim 2, wherein in the second contacts the grounding contact is located between a pair of signal contact for transmitting high speed signal and a pair of signal contacts for receiving high speed signal.

4. The cable connector assembly as claimed in claim 1, wherein the second enlarged portion is behind the soldering portions along the front to back direction.

5. The cable connector assembly as claimed in claim 1, wherein the second enlarged portion has a larger size than the first extending portion.

6. The cable connector assembly as claimed in claim 5, further comprising a spacer assembled to the insulative housing and the second contacts, and wherein the second enlarged portion is exposed beyond a back end of the spacer.

7. The cable connector assembly as claimed in claim 1, wherein the grounding contact comprises a front contacting portion, a retaining portion extending rearwards from the contacting portion, and a conjunction portion extending rearwards from the retaining portion.

8. The cable connector assembly as claimed in claim 7, wherein the pair of soldering portions are connected with opposite ends of the conjunction portion.

9. The cable connector assembly as claimed in claim 7, wherein the extending configuration is located between the two soldering portion along a vertical direction and extends backwards from the conjunction portion.

10. A cable connector assembly comprising:

an insulative housing defining a front mating port;

a plurality of passageways disposed in the housing along a front-to-back direction and communicating with said mating port;

a plurality of contacts inserted into the corresponding passageways from a rear side of the housing, respectively, each of said contacts defining a front contacting section exposed in the mating port and a rear soldering section; and two differential pair wires located behind the housing, each pair of said differential pair wires including a pair of signal wires commonly enclosed in a metallic foil wherein a front end portion of the metallic foil is removed to exposed front end sections of the respective signal wires in a divergent manner to have a corresponding inner conductor of the exposed front end section of each signal wire exposed to be soldered to the soldering section of the corresponding contact; wherein a grounding contact of said contacts further forms an enlarged section rearward extending beyond a rear side of the housing and the rear soldering sections to segregate divergently arranged exposed front end sections of said two differential pairs;

wherein said enlarged section extend rearwardly with a distance essentially at least terminated at or further beyond a front end of the remaining metallic foil so as to replace the removed front end portion of the metallic foil for shielding consideration to prevent electrical interference between said two different pairs; and wherein said enlarged section defines a Z-like cross-section viewed in the front-to-back direction.

11. The cable connector assembly as claimed in claim 10, wherein the contacting sections are arranged in one row while the soldering sections are arranged in two rows to comply with said two differential pairs which are essentially located two different levels in a vertical direction perpendicular to said front-to-back direction.

12. The cable connector assembly as claimed in claim 10, wherein said grounding contact defines two soldering sections respectively soldered to corresponding grounding wires of said two differential pairs, respectively.

13. The cable connector assembly as claimed in claim 10, further including a spacer attached to the rear side of the housing and defining along the front-to-back direction a plurality of through slots in which the soldering sections of the corresponding contacts is respectively received and further supportably exposed to an exterior in a vertical direction perpendicular to said front-to-back direction, and said enlarged section is exposed behind a rear face of the spacer.

14. A cable connector assembly comprising:

an insulative housing defining a front mating port;

a plurality of passageways disposed in the housing along a front-to-back direction and communicating with said mating port;

a plurality of contacts inserted into the corresponding passageways from a rear side of the housing, respectively, each of said contacts defining a front contacting section exposed in the mating port and a rear soldering section; and at least one differential pair wire each including a pair of signal wires commonly enclosed in a metallic foil wherein a front end portion of the metallic foil is removed to exposed the respective signal wires in a scattering manner to have a corresponding inner conductor of each signal wire exposed to be soldered to the soldering section of the corresponding contact; wherein a grounding contact of said contacts includes the corresponding soldering section to have a grounding wire of said differential pair wire soldered thereon, and further forms an enlarged section rearward extending far beyond a rear side of the housing, and at least terminated at or further beyond a front end of the remaining metallic foil to perform a shielding function in place of the removed front end portion of the metallic foil; and wherein said enlarged section defines a Z-like cross-section viewed in the front-to-back direction.

15. The cable connector assembly as claimed in claim 14, further including a spacer discretely located behind and assembled to the housing so as to support the soldering sections of the corresponding contacts in a vertical direction perpendicular to said front-to-back direction, and said enlarge sections is exposed outside of a rear face of said spacer.

16. The cable connector assembly as claimed in claim 14, wherein said enlarged section rearward extends beyond the rear soldering sections.

* * * * *